United States Patent [19]

Fichot et al.

[11] Patent Number: 5,077,536

[45] Date of Patent: Dec. 31, 1991

[54] DEVICE FOR PROTECTING ELECTRIC POWER RESISTANCES AND ANTI-OVERPRESSURE SYSTEM

[75] Inventors: Bernard Fichot, Fleurey-Sur-Ouche; Jean-Pierre Perrichon; Bernard Joubert, both of Montbard, all of France

[73] Assignee: Le Metal Deploye, Montbard, France

[21] Appl. No.: 499,328

[22] PCT Filed: Oct. 3, 1989

[86] PCT No.: PCT/FR89/00511

§ 371 Date: Jun. 18, 1990

§ 102(e) Date: Jun. 18, 1990

[87] PCT Pub. No.: WO90/04257

PCT Pub. Date: Apr. 19, 1990

[30] Foreign Application Priority Data

Oct. 3, 1988 [FR] France ..... 88 12913

[51] Int. Cl.[5] ..... H01C 1/024

[52] U.S. Cl. ..... 338/237; 174/52.3; 174/17.05

[58] Field of Search ..... 338/237, 232; 174/17.05, 50.5, 11 R, 17 VA, 52.1, 52.3; 361/381, 383, 384, 390

[56] References Cited

U.S. PATENT DOCUMENTS 4,235,347 11/1980 Cothier et al. ..... 174/17 VA

*Primary Examiner*—Marvin M. Lateef

*Attorney, Agent, or Firm*—McAulay Fisher Nissen Goldberg & Kiel

[57] ABSTRACT

A device for the protection of electric power resistances assembled in a battery using rods, insulating guns and isolators all housed within a dust tight and water jet tight parallelepipedic metallic housing, containing only air for cooling the resistances; fixing screws are provided for assembling and holding the various panels together and seals with a cut-out are provided in all assembly areas between the panels so that electrical continuity between two adjacent parts of the panels is achieved through despite any possible loosening; a compression element is interleaved between two adjacent parts of the panels to be assembled, at right angles to passages for the fixing screws, and the compression element is interleaved between the two adjacent parts for producing on opposite faces of the parts a force greater than the rigidity of the parts and housed in the thickness of the cut-out in the seals providing for contact tightness of the parts of the panels without limiting efficiency.

21 Claims, 4 Drawing Sheets

DEVICE FOR PROTECTING ELECTRIC POWER RESISTANCES AND ANTI-OVERPRESSURE SYSTEM

BACKGROUND OF THE INVENTION

1. Field of the Invention

The present invention is concerned with improvements in metal enclosures intended to protect in a water-tight manner and from the air electric power resistances, in particular those intended to limit the amplitude of fault currents, these resistances being mounted inside such enclosures containing exclusively air.

2. Description of the Prior Art

It is usual to observe that industrial electric resistances are mounted in open metal protective enclosures; in fact, their more or less widespread use requires the provision of rapid evacuation of calories due to the Joule effect by judiciously using convection movements of the air.

However, it is known that such resistances, particularly those grounding resistances whose role is to limit the amplitude of fault currents during a time sufficient to allow safety means to operate must be able to withstand currents which can reach one thousand amperes and even more for a period of time varying from a few seconds to a few tens of seconds. Thus the operative elements of these resistances must be able to withstand voltages which can reach several tens of kilovolt during the circulation of the fail current. For this reason, it is a constant to provide a protective enclosure for the resistances with respect to the external medium complimentarily giving a protection to the personnel with respect to the voltage at the terminals of the active elements which results from the passage of a fault current.

The type of enclosure which is the most current does not give any protection against dust or polluting particles of natural origin such as, for example sand, or from industrial sources which most often are very fine and tend to deposit on the insulators of the securing means for the resistances inside the said enclosures; the pollution phenomena moreover is further aggravated by the presence of considerable electrostatic charges which result from the high voltages which must be withstood by the same insulators.

It is known that this type of pollution leads to the breakage and even to the deterioration of the insulators if they are not regularly cleaned, and whose extent naturally is related to the amount of pollution on the site. This type of maintenance of course is very costly, and even impossible under certain conditions of use of the networks.

In this connection, numerous solutions already have been suggested for the creation of such resistances called "maintenance free". These solutions have generally involved the use of insulators which have leak lines into the air which are considerably greater than those of the insulators which are normally necessary; the excessive size of the insulator cannot solve the problem of pollution, at the most, it spaces out the frequency of the maintenance.

SUMMARY OF THE INVENTION

The present invention seeks to remedy such drawbacks by using water tight enclosures which are resistant, not only to dust, but also to sprays of water, according to class IP 55 of French standard NCF-20010. Noting that for the sake of economy, said protective enclosures preferably constituting the chassis supporting the active parts of the resistances are made from rectangular metallic plates assembled so as to form a parallelepipedal enclosure comprising a top, a bottom and four lateral walls; in such an economically advantageous construction it is necessary to provide a seal for sealing the enclosure. This seal is systematically mounted between all the elements forming the chassis with the unwanted effect of electrically insulating the metallic parts among each other; there results a problem of continuity of mass, which the screws securing the various elements cannot really regulate, owing to the appreciable risk of the loosening of the same securing screws, owing to the effect of vibrations and of the normal thermal stresses for this type of material. It will be noted, moreover, that the joints can move with time, further worsening the phenomena.

Therefore, there is proposed in accordance with the invention, a device for protecting electric power resistances, particularly for grounding resistances assembled in a battery, by the conventional means of rods, insulating guns and insulators inside a parallelepipedal metallic casing, dust tight and water jet tight and containing nothing but air for the cooling of such resistances, a device formed by four side panels, a bottom panel and a top panel, which are assembled by fixing screws, and are provided with seals in all their assembly areas, so that the electric continuity between two parts is achieved by said fixing screws, despite any possible loosening, characterized by the fact that between two metal parts to be assembled, at right angles to the passages of the fixing screws is interleaved a compression element, which produces on the opposite faces a force higher than the rigidity of said parts, said element being housed in the thickness of an appropriate cut-out photoseal, providing for contact tightness of said parts, without limiting the efficiency.

It will be understood that all the advantages of such a solution, tending to create, regardless of the extent of tightness of the bolts, a sufficient pressure between the mechanic linking parts of the fixing screws, so that the contact resistance is small as possible, so as to thereby obtain an optimum continuity of the mass.

In principle, the electrical power resistances intended for grounding assemblies or electrical networks do not require special ventilation in order to evacuate losses through the Joule effect, since, hypothetically, such installations are supposed to function ad abatically; this therefore leads to undersize the protective enclosures for resistances of this type, for reasons of simple economy, with the sometimes disastrous result of an excessive heating of the air within the enclosure owing, for example, to an abnormally long defect. There occurs naturally an internal overpressure which can rapidly deteriorate the protective enclosure, the thickness of whose walls evidently is not designed to resist such momentary excess pressure.

It is therefore suggested, according to another feature of the invention, to make a protective device for metallic parallelepipedal enclosures, dust and water jet tight, wherein the tight enclosure is provided with an anti-overpressure system such as, for example, a discharge valve or any other equivalent means, limiting the risks of deformation of the enclosure, which would otherwise create sealing defects and even the breaking of the insulators.

In this manner, it is possible to provide protective housings for electric power resistances conditioned for an adiabatic operation, with the advantage of a momentary and efficient protection, in case of an internal overpressure resulting from a continuing flaw. Several anti-overpressure systems are auxiliary proposed in the invention, as will be shown in the following lines. Other advantages will appear from the description which will be made of a particular embodiment and preferred version of the invention, given by way of non limiting example, reference being had to the accompanying drawings, in which:

BRIEF DESCRIPTION OF THE DRAWINGS

FIG. 1 of the accompanying drawings, housing 1

Figure 1:
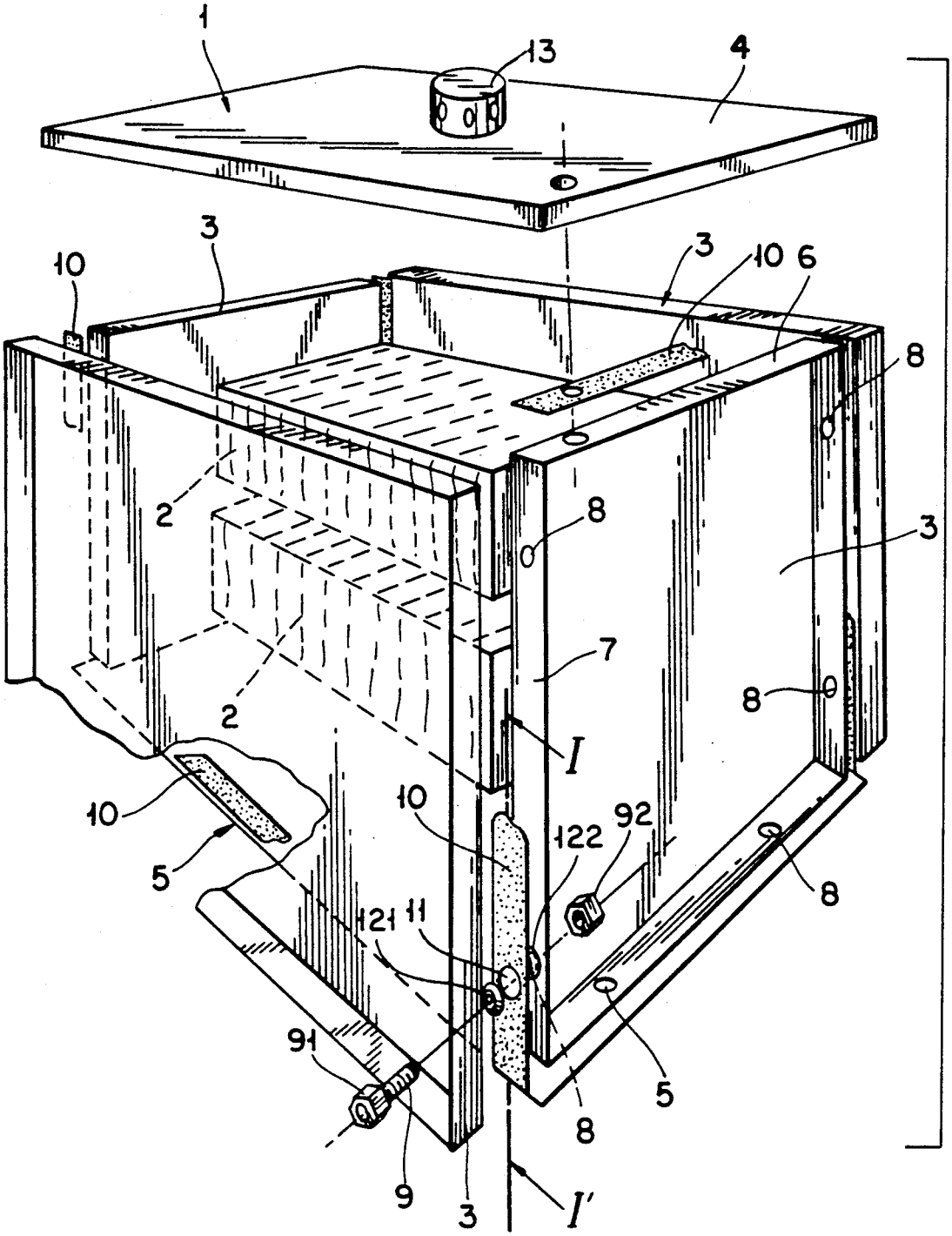
FIG. 1 is an exploded view giving a perspective diagram of the tight parallelepipedic housing according to the invention.

According to is intended to protect electric power resistances 2 mounting a battery inside the said housing, through insulators and insulating guns a in known manner; housing 1 does not contain any cooling fluid for resistances 2 which are intended in principle to limit the fault currents, which appear normally only very briefly and for a very short duration of time, to create an adiabatic heating situation.

Housing 1, which must be dust and water jet tight, with respect to class IP 55 of French standard NFC-20010, is constructed in the usual manner by four metallic sidewalls 3 which are rectangular in shape and have a thickness which suffices to mechanically support resistance batteries 2; these sidewalls 3 are mounted at right angles in such a way that in combination with a top wall 4 and a bottom wall 5, which have a shape and size in proportion with sidewalls 3, the housing 1 shall have the general shape of a parallelepipedic rectangle.

Each sidewall 3 has along its entire perimeter horizontal sides 6, and vertical sides 7, formed by conventional folding; these edges 6 and 7, in addition to their usual contribution to the mechanical stiffness of the wall, are advantageously used to receive passages 8 of fixing screws 9 and to serve as support surfaces for the seals 10 mounted between successive walls 3, between walls 3 and the top wall 4 or the bottom wall 5. Joints 10, made conventionally from an elastic material, are cut out as longitudinal strips having a width identical to the height of the edges 6 or 7 of walls 3 and of a thickness in the order of a few millimeters with respect to the mass continuity of the device now described by referring to FIG. 2 of the drawings. Perpendicular to each passage 8 of fixing screws 9, the joint 10 has a cut-out 11 which is preferably circular and has a diameter smaller than the width of said joint 10, to avoid all sealing rupture, so that, within the well constituted by the cut-out 11 of joint 10, it is possible to house entirely at least one elastic washer 12, axially traversed by the threaded stem of screw 9.

It is evident that the elastic washer 12 can be of any shape or material, as long as it acts by axial compression, during assembly by screw 8, by pushing back the assembled surfaces with a force in excess to the stiffness of said surfaces. Under these conditions, it is evident that the thickness of joint 10 is such that the tightness sought remains, even when there is a slight accidental loosening due, for example, to the vibrations of the housing, while elastic washer 12, by performing its function, pushes back the assembled surfaces; it will be noted, moreover, that the thickness of the same joint 10 is at least greater than the residual height of washer 12 when it is completely compressed.

Several modifications of such washers 12 are suitable in the device of the invention such as the use of a helical spring or still of truncated washers known under the commercial name of "Belleville" washers.

Figure 2:
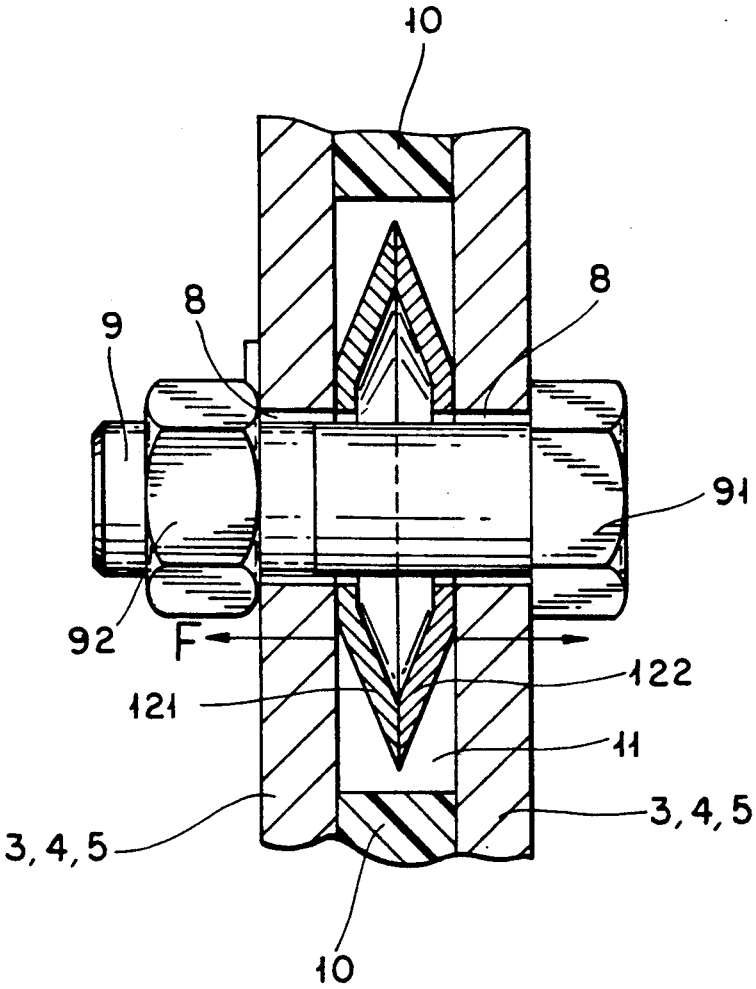
FIG. 2 is a partial and enlarged cross-sectional view along line I—I' of FIG. 1, of the continuity device united by the fixing screws of the invention, and used in assembling the elements of the tight housing of FIG. 1.

In a preferred embodiment of the device according to the invention, in accordance with FIG. 2, there is positioned perpendicular to passages 8 of fixing screws 9, within the cutouts 11 of the seal 10, two identical elastic washers 121 and 122, preferably of the truncated type called "Belleville", and mounted in inverted fashion in such a way that their large base coincide and that their peak respectively bear against the two surfaces to be assembled. It is naturally understood that the stacking of the washers 12 in the modification above described must have all the mass characteristics already described above in the variation of the base.

Regardless of the embodiment of the mass continuity system, it will be understood that the advantages resulting from the invention, since the contact of the head of screw 9 and of its bolt 92 respectively on the metal surfaces of walls 3, 4, 5 to be assembled, will remain sufficiently firm to form a suitable and identical connection with electric mass, and this even indicates of accidental loosening.

According to another main feature of the invention, the anti-housing 1 is provided with an anti-overpressure device 13 making it possible, if necessary, to decompress the air existing within housing 1, and whose temperature may have risen because of a long duration failure on the electric network which protects the grounding resistance 2 located in housing 1, the same being dust and water jet tight as has been said.

It therefore has been imagined to place on the parallelepipedic housing 1 protecting the batteries with grounding resistance 2 a discharge valve, adjusted to a value capable of avoiding all mechanical destruction of said housing 1 or of the assemblies of its constituting elements.

Figure 3:
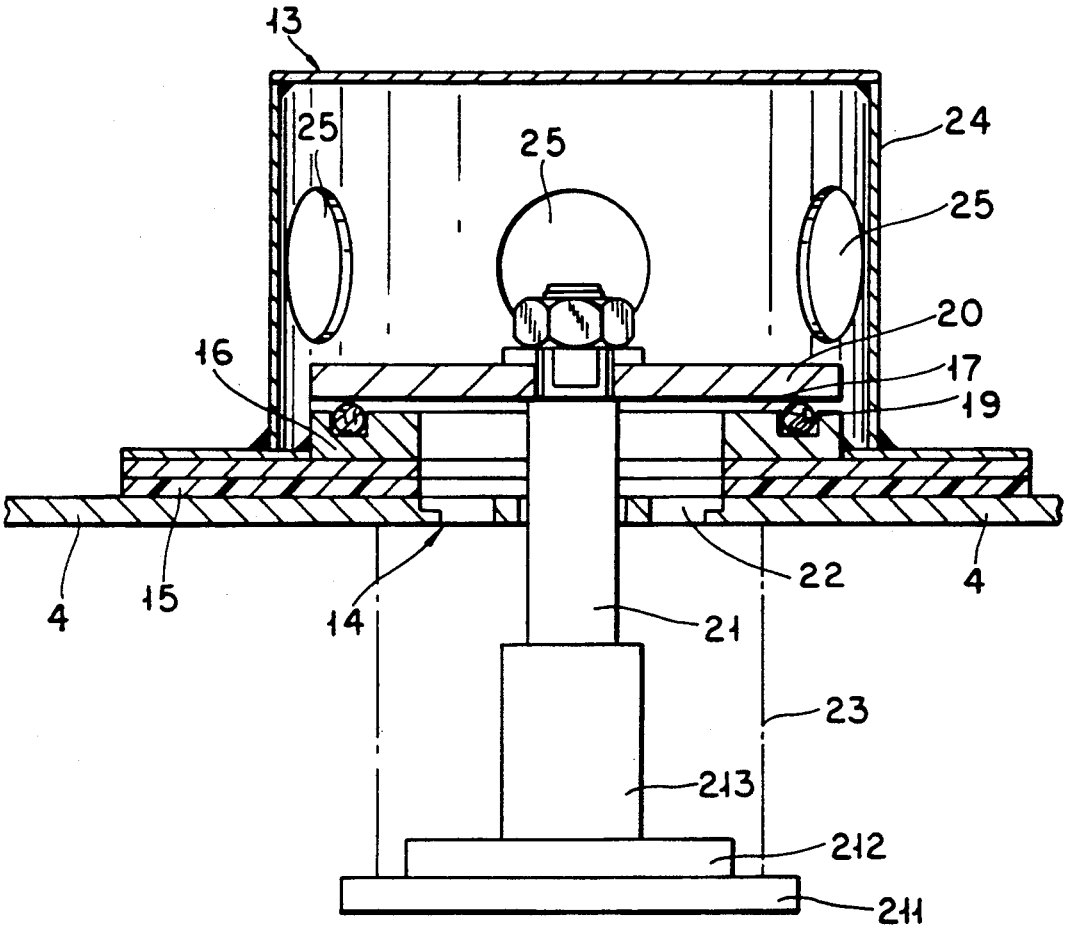
FIG. 3 is a vertical cross-sectional and elevational view of a modification of the device according to the invention, for protecting the tight housing of FIG. 1 against internal overpressures due to the heating of the electric resistances it contains.
Figure 4:
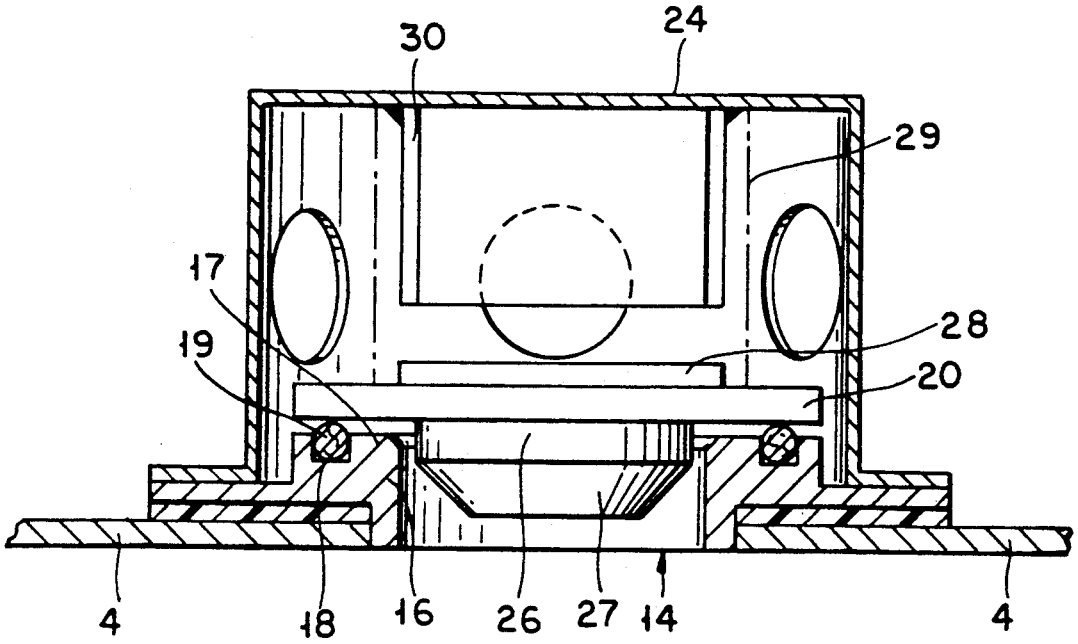
FIG. 4, is a modification of the anti-overpressure device above in accordance with the invention, according to the same view as FIG. 3, and FIG. 5, is a vertical cross-sectional elevational view of another embodiment of the overpressure device according to the invention.

A first embodiment is proposed with reference to FIGS. 3 and 4 of the drawings: the top wall 4 of housing 1 is provided with a cut-out 14, which is preferably circular, on which is mounted lightly through seal 15, a first annular part 16, whose internal diameter is equal to that of the cut-out of top wall 4. Part 16 has on its upper side 17, a circular and concentric groove 18 intended to receive a toroidal joint 19, the assembly forming the seat of a movable element acting like a valve; to this purpose, a second disk-like part 20 rests normally on the toroidal joint 19, in such a way as to tightly close the opening made at 14 on the top wall 4 of housing 1; the disk 20, in a first modification of this embodiment, in conformity with FIG. 3, is moved axially by the movement of a stem 21 which has a shoulder and is made integral with part 20 in known manner, and is able to slide vertically and freely in the axis of cut-out 14; a cut-out washer 22 advantageously can cooperate and in the guiding of the stem 21, while placing the inner surface 201 of part 20 in equal pressure with the ambient air within housing 1; the shouldered stem 21 is provided at its lower extremity, located inside the housing 1, with a first shoulder 211 assuring the maintenance of an helicoidal spring 23, centered within the axis of the valve by a second shoulder 212, compressed on the inner surface of top wall 4, in such a way that it urges downwardly the mobile part of the valve, as a possible complement of the weight itself of the same assembly; it is obviousness that the stiffness K of spring 23 is calculated so that, bearing in mind the weight of the movable parts, the internal pressure be limited to 0.2 bars. A hood 24 provided with air vents 25, finally protects the valve thus made.

It will be noted that such an embodiment is particularly advantageous, for reasons of rusticity, which renders it practically insensitive to damage by corrosion or by polluting elements.

According to a second modification of the same embodiment, in conformity with FIG. 4, the seat of valves 16, 17, 18, 19 is the same as in the previous modification, and the disk 20 does not include a stem 21 for its axial guiding; a first circular shoulder 26, preferably provided with a chamfered nose 27, is brought back on the inside surface of part 20, with which it is concentric; its diameter is slightly less than that of opening 14 of top wall 4, in such a way as to limit the horizontal movements of the mobile assembly; besides, a second shoulder 28 is provided on the external surface of closure 20, to receive a center and helicoidal spring 29, which, bearing on the inner surface of the cut-out protective hood 24, presses the closure 20 on its seat 16, by toroid joints 19.

Accessorily, a tube 30, integral with the inner surface of hood 24, cooperates with the guiding of spring 29 which winds around said tube 30, which serves also advantageously to limit the height of the movement of the valve; to this effect, in the previous variation, the shoulder 213 of stem 21 performs the same function, by limiting the vertical movement as it hits on guiding washer 22.

It is clear that the independent variation which has just been described is particularly adapted in the case where it is desired to provide an existing housing 1 with the anti-overpressure device.

Figure 5:
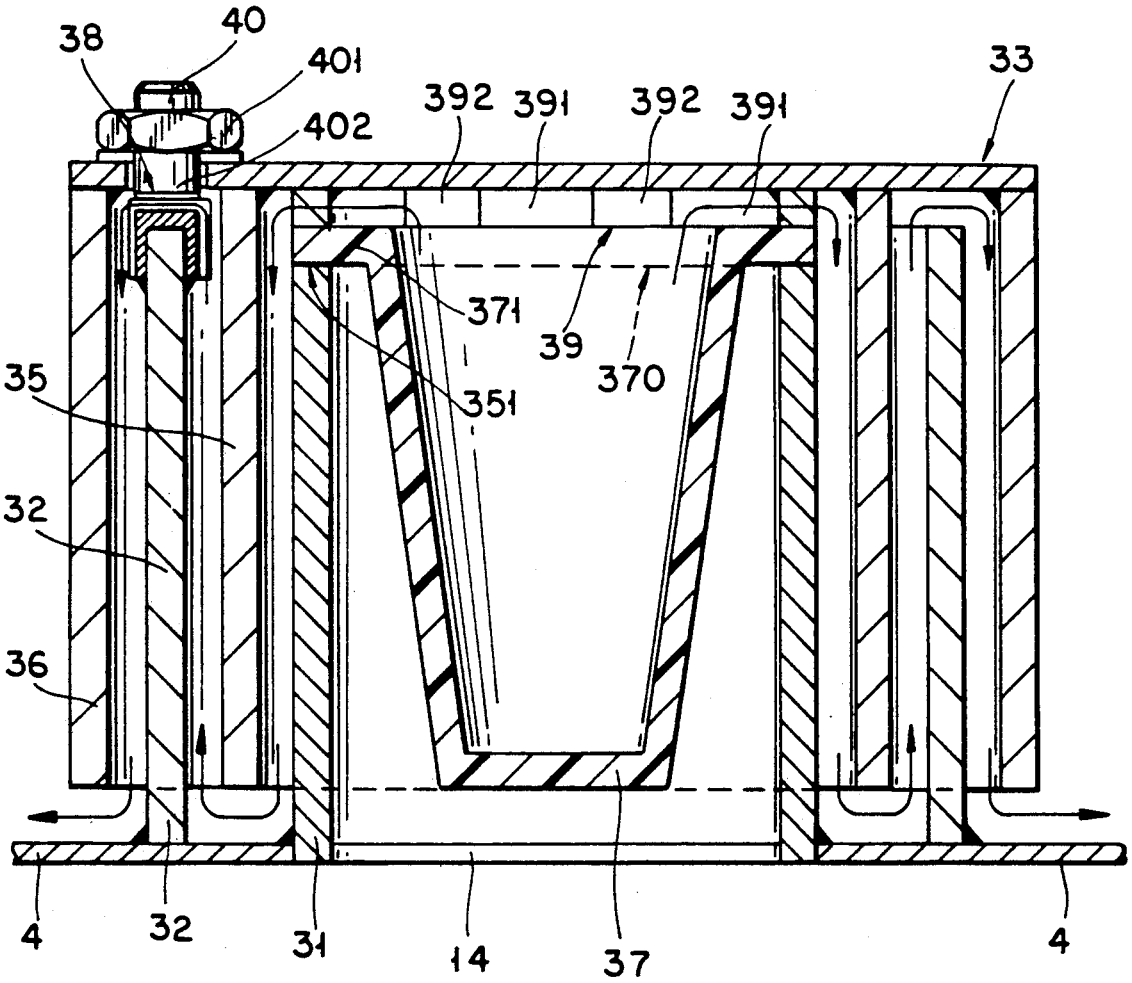

A second embodiment of the internal anti-overpressure device according to the invention is described with respect to FIG. 5; it consists, essentially, of a filtering grill for airing permanently the internal atmosphere in the inside of the housing 1, thus avoiding all internal overpressure, while respecting the tightness specifications of class IP 55 of French standard NFC-20010.

Starting with cut-out 14 of top wall 4 of housing 1, a first vertical tube 31 having a sufficient height and a diameter equal to that of opening 14 and a second tube 32 concentric with the first tube 31, and having substantially the same height but a greater internal diameter, are fixed to housing 1, for example by welding, perpendicular to opening 14 in such a way that by cooperating, on the one hand, with a removable hood 33 formed by a disk 34 from which issue coaxially two concentric tubes 35, 36 having an internal diameter such that for the smallest, it is comprised between the diameters of the first and second tubes 31, 32 coming out of housing 1, and for the other that it be greater to the diameter of the second tube 32 coming out of housing 1, and having a height substantially equal to said tube 31, 32 in such a way that said hood 33 surmount the opening 14 by encasing coaxially tubes 35, 36, and on the other hand, by cooperating with a filter 37 positioned for example at the upper end of the first tube 31 coming out of housing 1, with suitable vertical stops 38, 39 between tubes 31, 32, 35, 36 provided with fixing screws 40, so that the assembly forms an anti-overpressure baffle producing a suitable seal against dust and jet of water.

It goes without saying that the baffle thus made will be fully effective if the air circulation paths comprised between concentric tubes 31 and 35 on the one hand, 35 and 32 on the other hand, and finally 32 and 36, are freed; this is especially obtained by struts 38 symmetrically spaced at the upper ends of tube 32 which is connected to housing 1.

These struts 38 have for effect to upwardly move hood 33, while providing its fixing means; to this effect, each strut 38 has a threaded end screw 40, allowing tightening of hood 33 by means of screw 401 on shoulder 402 of strut 38.

In addition, filter 37 has a filtering size adapted to the type of pollution from which protection is sought, and consists essentially of an upper opening 370 along whose periphery is positioned a small horizontal collar 371 resting on the upper part of tube 31 and mostly within the baffle. An annular strut 39 is positioned on collar 371 of filter 37 to serve as a strut for hood 33 and to block said element 37. Lights 391 alternate radially with the full parts 392 to form the entrance of the baffle.

It also would be possible to replace small collar 39 by a simple annul and wavy washer which would form a spring for holding filter 37 and would form a strut for hood 33.

Finally, it is evident that all solutions tending to simplify the baffle such as described above, in particular by using a simple filter 37 whose structural characteristics would comply with class IP 55 of French specification standard NFC 20-20010, would not depart from the scope of the invention.

we claim:

1. A device for the protection of electric power resistances, particularly grounding resistances assembled in a battery (2), by means f rods, insulating guns and isolators and housed within a dust tight and water jet tight parallelepipedic metallic housing (2), containing only air for cooling said resistances; said housing comprising:

four side panels (3), a bottom panel (5) and a top panel (4);

fixing screws (9) for assembling and holding said panels together and forming assembly area between said panels;

seals (10) provided in all said assembly area between said panels so that electrical continuity between two adjacent parts of said panels (3, 4, 5) is achieved through said fixing screws (9), despite any possible loosening, and seals having a cut-out (11); and a compression element (12) interleaved between said two adjacent parts of said panels (3, 4, 5) to be assembled, at right angles to passages (8) for said fixing screws (9) of the said pairs of said panels (3, 4, 5), said compression elements (12) being interleaved between said two adjacent parts for producing on opposite faces of said parts a force (F) greater than the rigidity of said parts and housed in the thickness of said cut-out (11) in said seals (10) providing for contact tightness of said parts of said panels (3, 4, 5) without limiting the efficiency.

2. The device according to claim 1, wherein said compression element is formed from a truncated elastic washer (12).

3. The device according to claim 1, wherein said compression element is a washer, and said fixing screw (9) traverses said washer.

4. The device according to claim 1, wherein said compression element is a helicoidal spring, and said fixing screw (9) traverses said spring.

5. The device according to claim 1, wherein said compression element comprises two stacked elastic truncated washers (121, 122) mounted head-to-tail along their large base, the top of each said washer being positively supported against the opposite faces of the metallic parts of said panels (3, 4, 5).

6. The device according to claim 11, wherein said compression element comprises two elastic identical truncated washers (121, 122) mounted head-to-tail along their large base, the top of each said washer being positively supported against the opposite faces of said parts of said panels (3, 4, 5).

7. A device for protecting electric power resistances, particularly grounding resistances, assembled in a battery (2), by conventional means of rods, insulating guns and isolators inside a dust tight and water jet tight parallelepipedic metal casing (1) and containing only air to cool said resistances (2); said casing comprising:

four lateral walls (3), a bottom wall (5) and a top wall (4); and an anti-overpressure system including discharge valve means for limiting risks of deformation of said housing (1), whereby to prevent creation of sealing defects and breaking of the isolators;

said housing (1) having an opening (14), and an annular part (16) on said top wall (4) of said housing (1) forming an anti-depressive element brought back in a sealing fashion, around said opening (14); and said annular part having on its upper surface a circular groove (18), and a toric seal (19) maintained in said circular groove (18) for forming a seat for the reception of a disk-like valve element (20) acting as a valve, said disk-like valve element (20) having the general shape of a disk, and normally bearing sealingly on said toric seal (19) to form a joint by means formed of its own weight, and of a compressive spring (23) so that said valve element (20) provided with a bearing surface subjected to the inner pressure of housing (1), is pushed back upwardly when the internal pressure exceeds a predetermined safety threshold.

8. The device of claim 7, including:

a rod (21) for said valve element (20) extending from the center of the bearing surface of said valve element (20) and downwardly by passing with play said seat integral with said top wall (4) of said housing (1) so that said rod (21) ensures the vertical guidance of the mobile assembly; and a compression spring (23) positioned coaxially around said stem (21) bearing on one side upwardly on the inner surface of said top wall (4), and from the other side to provide a return effect by bearing downwardly on a shoulder (211) of said rod (21), for applying said valve element (20) against its seal (16) as long as the internal pressure of housing (1) remains below the safety threshold.

9. The device of claim 7, wherein said part (16) is annular.

10. The device of claim 9, including:

a rod (21) for said valve element (20) extending from the center of the bearing surface thereof and downwardly by passing with play the seat integral with said top wall (4) of said housing (1) so that said rod (21) ensures the vertical guidance of the mobile assembly; and a compression spring (23) positioned coaxially around said stem (21) bearing on one side upwardly on the inner surface of said top wall (4), and from the other side to provide a return effect by bearing downwardly on a shoulder (211) of said rod (21), for applying said valve element (20) against its seat (16) as long as the internal pressure of housing (1) remains below the safety threshold.

11. The device of claim 9, wherein said valve element (20) is provided on its bearing surface with a shoulder (26) cylindrical with a vertical axis.

12. The device of claim 11, wherein said shoulder has a chamfered nose (27) for ensuring a rough horizontal guiding to the mobile assembly urged back on its seat (16) by its own weight.

13. The device of claim 7, wherein said valve element (20) is provided on its bearing surface with a shoulder (26) cylindrical with a vertical axis.

14. The device of claim 13, wherein said shoulder has a chamfered nose (27) for ensuring a rough horizontal guiding to the mobile assembly urged back on its said seat (16) by its own weight.

15. The device of claim 13, wherein said valve element (20) is provided on its external surface with a cylindrical shoulder (28) having a vertical axis for centering a vertical compression spring (29), along the same axis as said valve element (20), for applying said valve element (20) against said sat (16) by bearing through its upper end on the inner surface of a hood (24) integral with said top wall (4) for surmounting the entire anti-overpressure system, said hood (24) including a cylindrical element (30) coaxial with said valve element (20) and having a height sufficient to maintain and guide said compression spring (29) and to serve in auxiliary fashion as an end stop for the vertical movement of said valve element (20).

16. The device of claim 7, wherein said housing (1) on the horizontal upper surface (4) thereof is provided with an opening (14), and including a first vertical tube (31) having a sufficient height and a diameter equal t that of the opening (14) and a second tube (32) concentric with the first tube (31) positioned on said housing (1), said second tube (32) being of substantially the same height and of a greater inner diameter than said first tube (31) and being made integral with said housing (1), perpendicular to said opening (14) to cooperate with a removable hood (33) formed from a removable disk (34), two coaxially concentric tubes (35, 36) extending from said disk (34), one of said concentric tubes (35) having an internal diameter less than the internal diameter of said other concentric tube (36) and is positioned between said first and second tubes (31, 32) and said concentric tubes (35, 36) having a height substantially equal to the height of said first and second tubes (31, 32) such that said hood (33) surmounts said opening (14) by encasing coaxially said first and second tubes (31, 32) and said concentric tubes (35, 36) and cooperating with a filter

(37) positioned on an upper segment of the first tube (31) issuing from housing (1) and with vertical stops (38, 39) between said tubes (31, 32, 35, 36), and fixing screws (40), to assemble an anti-overpressure baffle providing a seal against dust and water jets.

17. The device of claim 16, wherein said filter (37) has a disk shape and rests on a segment (351) of said first tube (31), an annular collar (39) for maintaining said filter (37) on said first tube (31) and being provided with a perforated or wavy configuration which circularly punches the edges (371) of said filter (37) between said removable hood (33) and said segment (351) of the first tube (31).

18. The device of claim 16, wherein said filter (37) has a disk shape and is provided with an upper opening (370) surrounded by a horizontal collar (371) resting on an upper part of said tube (31).

19. The device of claim 16, wherein said second tube (32) is welded to said housing (1).

20. The device of claim 19, wherein said filter (37) has a disk shape and rests on a segment (351) of said first tube (31), an annular collar (39) for maintaining said filter (37) on said first tube (31) and being provided with a perforated or wavy configuration which circularly pinches the edges (371) of said filter (37) between said removable hood (33) and said segment (351) of the first tube (31).

21. The device of claim 19, wherein said filter (37) has a disk shape and is provided with an upper opening (370) surrounded by a horizontal collar (371), said collar (371) resting on an upper part of said tube (31).

* * * * *